US012208950B2

(12) United States Patent
Hettinger et al.

(10) Patent No.: US 12,208,950 B2
(45) Date of Patent: Jan. 28, 2025

(54) PANEL INTERLOCKING DEVICE

(71) Applicant: WestRock Packaging Systems, LLC, Atlanta, GA (US)

(72) Inventors: Peter Hettinger, Treierweiler (DE); Valentin Stamer, Trier-Erang (DE); Rainer Erschfeld, Trier-Erang (DE)

(73) Assignee: WestRock Packaging Systems, LLC, Atlanta, GA (US)

( * ) Notice: Subject to any disclaimer, the term of this patent is extended or adjusted under 35 U.S.C. 154(b) by 232 days.

(21) Appl. No.: 17/430,343

(22) PCT Filed: Feb. 6, 2020

(86) PCT No.: PCT/US2020/016986
§ 371 (c)(1),
(2) Date: Aug. 12, 2021

(87) PCT Pub. No.: WO2020/167578
PCT Pub. Date: Aug. 20, 2020

(65) Prior Publication Data

US 2022/0135302 A1 May 5, 2022

Related U.S. Application Data

(60) Provisional application No. 62/804,507, filed on Feb. 12, 2019.

(51) Int. Cl.
*B65D 71/14* (2006.01)

(52) U.S. Cl.
CPC .... *B65D 71/14* (2013.01); *B65D 2571/00185* (2013.01); *B65D 2571/0066* (2013.01)

(58) Field of Classification Search
CPC ..... B65D 71/14; B65D 2571/00185; B65D 2571/0066; B65D 2571/00716;
(Continued)

(56) References Cited

U.S. PATENT DOCUMENTS 4,243,143 A * 1/1981 Muller ..... B65D 71/12 229/185
5,765,685 A * 6/1998 Roosa ..... B65D 71/16 206/434

(Continued)

FOREIGN PATENT DOCUMENTS

CL 199802106 A1 5/1999
CL 201200426 A1 10/2012

(Continued)

OTHER PUBLICATIONS

International Search Report and Written Opinion issued in corresponding International Patent Application No. PCT/US2020/016986 on May 19, 2020. (13 pages).

(Continued)

*Primary Examiner* — Christopher R Demeree
(74) *Attorney, Agent, or Firm* — Brian J. Goldberg; Rohini K. Garg

(57) ABSTRACT

Aspects of the disclosure relate to a panel interlocking device, a carton, and a blank for forming the carton. The carton blank incorporating a panel interlocking device for securing together a first and a second panel in overlapping relationship. The panel interlocking device comprises a locking tab struck from the first panel, and a retaining tab defining a locking aperture struck from the second panel. In use the retaining tab is displaced out of the plane of the second panel to receive said locking tab through the locking aperture to be engaged therewith. The retaining tab has opposing side edges each concavely curved as viewed from the outside of the retaining tab.

20 Claims, 9 Drawing Sheets

(58) Field of Classification Search
CPC ..... B65D 2571/0016; B65D 71/12; B65D 2571/00154; B65D 2571/00228
USPC ..... 229/103.2, 185, 198.2; 206/140, 434, 206/427, 429
See application file for complete search history.

(56) References Cited

U.S. PATENT DOCUMENTS

| | | | | |
|---|---|---|---|---|
| 5,782,343 | A * | 7/1998 | Harrelson | B65D 71/20 229/198.2 |
| 6,315,123 | B1 * | 11/2001 | Ikeda | B65D 71/12 229/198.2 |
| 6,997,372 | B2 | 2/2006 | Gasparowicz | |
| 8,376,213 | B2 | 2/2013 | Brand | |
| 2002/0170949 | A1 | 11/2002 | Peterson | |
| 2008/0257945 | A1 * | 10/2008 | Auclair | B65D 71/20 229/185 |
| 2020/0277116 | A1 * | 9/2020 | Blin | B65D 71/20 |

FOREIGN PATENT DOCUMENTS

| | | | |
|---|---|---|---|
| CL | 201602795 | A1 | 4/2017 |
| CN | 1349469 | A | 5/2002 |
| CN | 1091733 | C | 10/2002 |
| DE | 8704027 | U1 | 5/1987 |
| EP | 0003935 | A1 | 9/1979 |
| EP | 1098822 | B1 | 9/2003 |
| EP | 1742851 | B1 | 4/2009 |
| ES | 2207257 | T3 | 5/2004 |
| TW | 201033088 | A | 9/2010 |
| TW | 201542426 | A | 11/2015 |
| TW | 201641372 | A | 12/2016 |
| WO | 9850284 | A1 | 11/1998 |
| WO | 2006083941 | A1 | 8/2006 |
| WO | 2010045287 | A1 | 4/2010 |
| WO | 2015171376 | A1 | 11/2015 |

OTHER PUBLICATIONS

Taiwan Patent Search issued Nov. 2023, 4 pages.
Chilean Office Action issued Aug. 2023, 10 pages.
JP Office Action issued Oct. 2023, 11 pages.

* cited by examiner

PANEL INTERLOCKING DEVICE

TECHNICAL FIELD

The present invention relates to cartons and to blanks for forming the same. More specifically, but not exclusively, the invention relates to panel interlocking devices for cartons for securing together a pair of panels, for example, adjacent overlapping panels of a paperboard carton. In some situations, these panels are provided by the opposite ends of a wrapper blank which are brought together in overlapping relationship and interlocked.

BACKGROUND

In the field of packaging it is known to provide cartons for carrying multiple articles. Cartons are well known in the art and are useful for enabling consumers to transport, store and access a group of articles for consumption. For cost and environmental considerations, such cartons or carriers need to be formed from as little material as possible and cause as little wastage in the materials from which they are formed as possible. Further considerations are the strength of the carton and its suitability for holding and transporting large weights of articles. It is desirable that the contents of the carton are secure within the carton.

Locking tabs which are struck from one end of the carton wrapper and which are arranged to be forced through corresponding apertures defined by retaining tabs, struck from an opposite end of a wrapper are well known. An example of such a lock is shown in FIG. 1 and corresponds substantially to GB 1 598 367.

A further example is illustrated in GB 2 156 785 and owned by the applicant of this invention. This document illustrates a wraparound carton with panel interlocking means comprising a locking tab which is required to be driven through an aperture.

The present invention seeks to provide an improved panel interlocking device which overcomes or at least mitigates the problems of the prior art.

SUMMARY

According to an aspect of the invention there is provided a panel interlocking device comprising a male tab and a female tab having opposing side edges each concavely curved as viewed from the outside of the female tab.

According to another aspect of the invention there is provided a panel interlocking device for securing together a first and a second panel in overlapping relationship, said panel interlocking device comprising a locking tab struck from said first panel, and a retaining tab defining a locking aperture struck from said second panel, wherein the retaining tab is displaced out of the plane of said second panel to receive said locking tab through the locking aperture to be engaged therewith, characterised in that the retaining tab has opposing side edges at least one of which is concavely curved as viewed from the outside of the retaining tab.

According to yet another aspect of the invention there is provided a panel interlocking device for securing together a first and a second panel in overlapping relationship, said panel interlocking device comprising a locking tab struck from said first panel, and a retaining tab defining a locking aperture struck from said second panel, wherein the retaining tab is displaced out of the plane of said second panel to receive said locking tab through the locking aperture to be engaged therewith, characterised in that the locking aperture has opposing side edges each concavely curved as viewed from the outside of the locking aperture.

Optionally, the centre of the curvature of each curved side edge is disposed outside the retaining tab.

Optionally, a minimum width F4 of the locking aperture is located between distal and proximal ends of the locking aperture such that both the width F5 at the distal end and the width F2 at the proximal end is greater than the minimum width F4, (F5>F4),(F2>F4).

Optionally, the width F2 at the proximal end is the maximum width.

Optionally, the radius r3 of curvature of each side edge is generally equal to two-thirds of the maximum width F2 of the female tab, ($r3 \cong \frac{2}{3} F2$).

Optionally, the male tab comprises a single-position tab comprising:

a main portion;

a neck portion; and a shoulder portion; wherein the neck portion is narrower in width than the shoulder portion to define at least one locking edge formed along the lower part of the shoulder portion and wherein the maximum width F2 of the female tab is greater than the maximum width M2 of the single-position tab, (F2>M2).

Optionally, the width F5 at the distal end of the female tab is less than the maximum width M2 of the single-position tab, (F5<M2).

Optionally, the female tab is connected to a mother panel by a non-linear fold line.

Optionally, the non-linear fold line comprises a curved fold line.

Optionally, the centre of the curvature of the curved fold line is located at a position closer to the distal end of the female tab than to the curved fold line.

Optionally, the fold line has a length F1 which is less than the maximum width F2 of the female tab, (F1<F2).

Optionally, the length F1 is less than the minimum width F4 of the female tab, (F1<F4).

Optionally, the fold line has a length F1 which is generally equal to the minimum width M1/M4 of the male tab, ($F1 \cong M1$), ($F1 \cong M4$).

Optionally, the male tab comprises a multi-position tab comprising a plurality of recesses along at least one side edge thereof, each recess providing an engagement or locking edge for abutment with a panel portion of a mother panel from which the female tab is struck and wherein the maximum width F2 of the female tab is greater than the maximum width M5 of the multi-position tab.

Optionally, the width F5 at the distal end of the female tab is less than the maximum width M5 of the multi-position tab, (F5<M5).

Optionally, the female tab has a distal end edge convexly curved as viewed from the outside of the female tab.

Optionally, the locking aperture has a distal end edge convexly curved as viewed from the outside of the locking aperture.

Optionally, the centre of the curvature of the curved distal end edge is located at a position closer to the proximal end of the female tab than to the distal end.

Optionally, the radius r2 of curvature of the distal end edge is greater the radius r3 of curvature of each of the curved side edges, (r2>r3).

Optionally, the radius of curvature r2 of the distal end edge is generally equal to the maximum width F2 of the female tab, ($r2 \cong F2$).

According to a further aspect of the invention there is provided a carton blank incorporating panel interlocking device having a first panel and a second panel, said panel interlocking means comprising a locking tab struck from said first panel, and a retaining tab defining a locking aperture struck from said second panel, wherein the retaining tab can be displaced out of the plane of said second panel to receive said locking tab through the locking aperture to be engaged therewith, characterised in that the retaining tab has opposing side edges each concavely curved as viewed from the outside of the retaining tab.

Within the scope of this application it is envisaged or intended that the various aspects, embodiments, examples, features and alternatives set out in the preceding paragraphs, in the claims and/or in the following description and drawings may be considered or taken independently or in any combination thereof.

Features or elements described in connection with, or relation to, one embodiment are applicable to all embodiments unless there is an incompatibility of features. One or more features or elements from one embodiment may be incorporated into, or combined with, any of the other embodiments disclosed herein, said features or elements extracted from said one embodiment may be included in addition to, or in replacement of one or more features or elements of said other embodiment.

A feature, or combination of features, of an embodiment disclosed herein may be extracted in isolation from other features of that embodiment. Alternatively, a feature, or combination of features, of an embodiment may be omitted from that embodiment.

BRIEF DESCRIPTION OF THE DRAWINGS

Embodiments of the invention will now be described with reference to the accompanying drawings, in which.

DETAILED DESCRIPTION OF EMBODIMENTS

Detailed descriptions of specific embodiments of the panel interlocking device, package, blanks and cartons are disclosed herein. It will be understood that the disclosed embodiments are merely examples of the way in which certain aspects of the invention can be implemented and do not represent an exhaustive list of all of the ways the invention may be embodied. As used herein, the word "exemplary" is used expansively to refer to embodiments that serve as illustrations, specimens, models, or patterns. Indeed, it will be understood that the panel interlocking device, packages, blanks and cartons described herein may be embodied in various and alternative forms. The Figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the invention.

Figure 1:
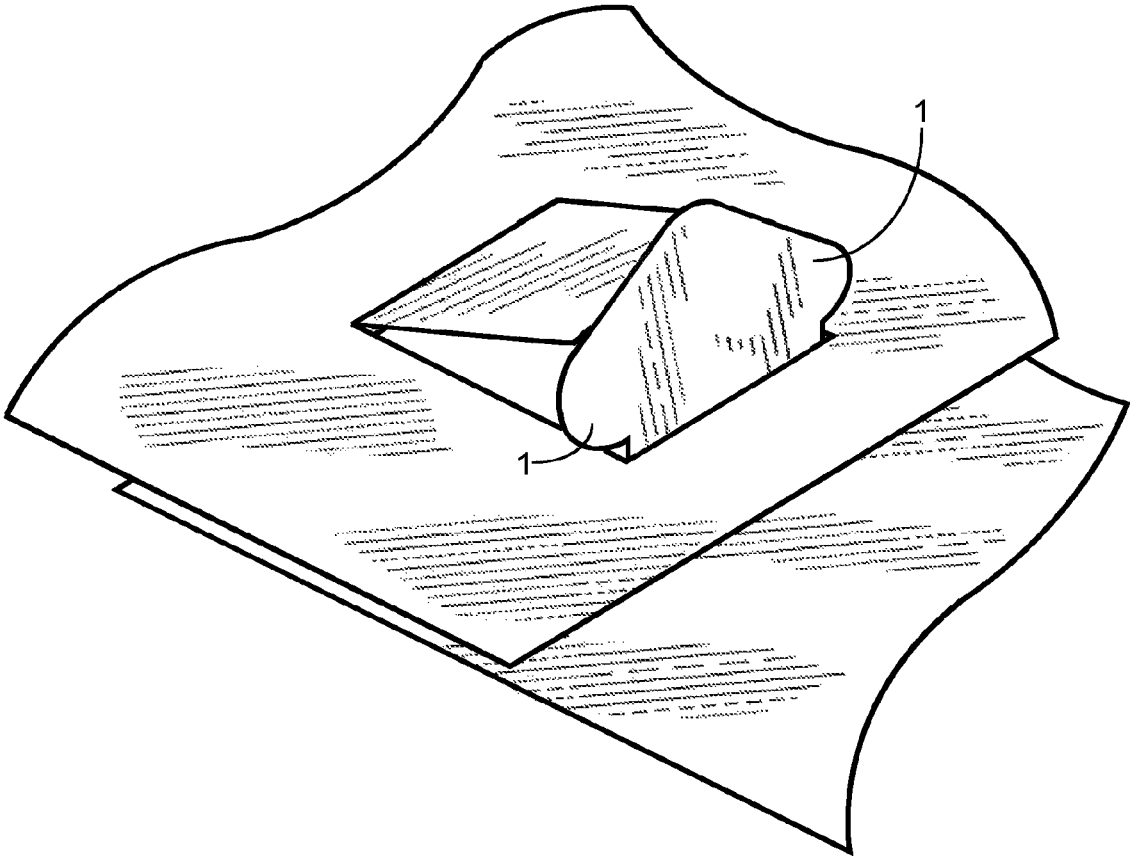
FIG. 1 shows a locking means substantially corresponding to patent number GB 1 598 368.
Figure 2:
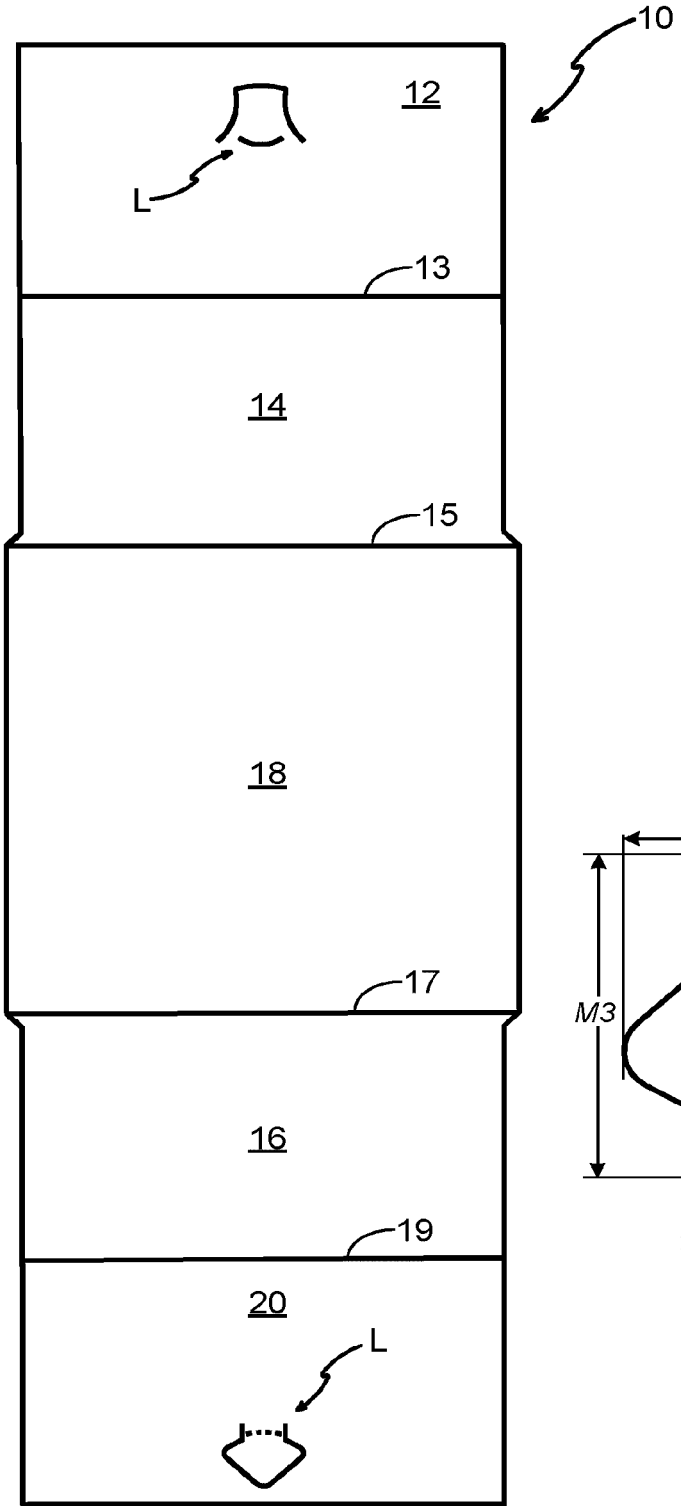
FIG. 2 illustrates a wraparound carton blank incorporating a panel interlocking device according to a first embodiment of the invention.

Referring to FIG. 2, there is shown a plan view of a blank 10 capable of forming a carton or carrier (not shown), for containing and carrying a group of primary products such as, but not limited to, bottles or cans, hereinafter referred to as articles (not shown). The blank 10 forms a secondary package for packaging at least one primary product container or package.

In the embodiments detailed herein, the terms "carton" and "carrier" refer, for the non-limiting purpose of illustrating the various features of the invention, to a container for engaging and carrying articles, such as primary product containers. It is contemplated that the teachings of the invention can be applied to various product containers, which may or may not be tapered and/or cylindrical. Exemplary containers include bottles (for example metallic, glass or plastics bottles), cans (for example aluminium cans), tins, pouches, packets and the like.

The blank 10 is formed from a sheet of suitable substrate. It is to be understood that, as used herein, the term "suitable substrate" includes all manner of foldable sheet material such as paperboard, corrugated board, cardboard, plastic, combinations thereof, and the like. It should be recognised that one or other numbers of blanks may be employed, where suitable, for example, to provide the carrier structure described in more detail below.

The packaging structures or cartons described herein may be formed from a sheet material such as paperboard, which may be made of or coated with materials to increase its strength. An example of such a sheet material is tear-resistant NATRALOCK® paperboard made by WestRock Company. It should be noted that the tear resistant materials may be provided by more than one layer, to help improve the tear-resistance of the package. Typically, one surface of the sheet material may have different characteristics to the other surface. For example, the surface of the sheet material that faces outwardly from a finished package may be particularly smooth and may have a coating such as a clay coating or other surface treatment to provide good printability. The surface of the sheet material that faces inwardly may, on the other hand, be provided with a coating, a layer, a treatment or be otherwise prepared to provide properties such as one or more of tear-resistance, good glue-ability, heat sealability, or other desired functional properties.

Figure 3C:
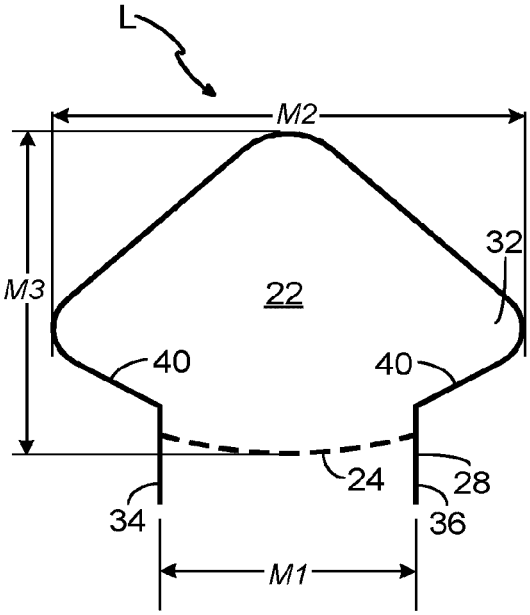
FIG. 3C shows an enlarged view of a retention tab for forming the panel interlocking device according to one aspect of the invention.
Figure 3:
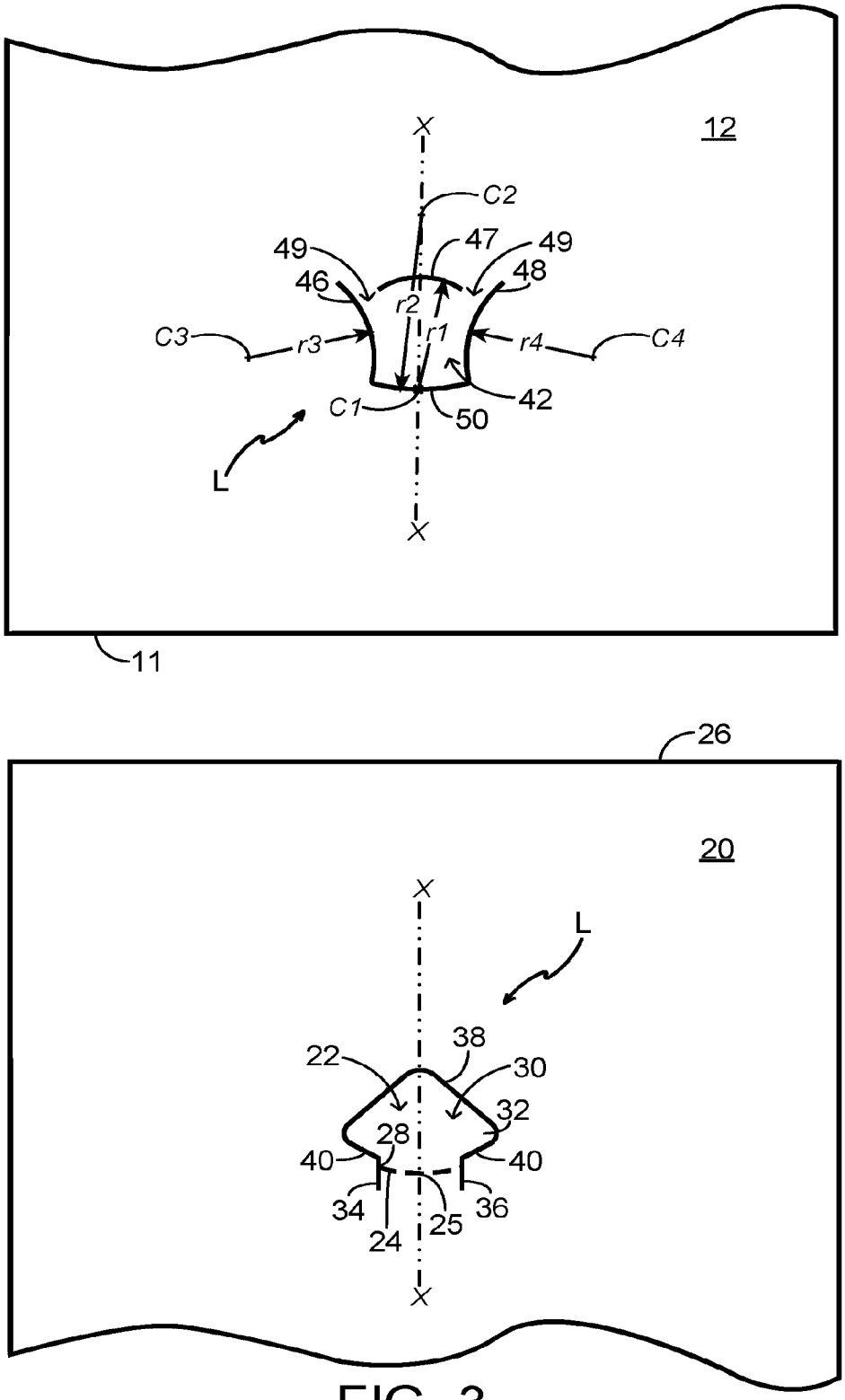
FIG. 3 shows a part of a pair of panels in close proximity, incorporating a panel interlocking device according to one aspect of the invention.

Referring to FIGS. 2 and 3 of the drawings, a pair of panels 20, 12 respectively are adapted to be interlocked and are formed from paperboard or similar foldable sheet material. The pair of panels 20, 12 may, for example, be disposed at the opposite ends of one and the same wraparound carton blank 10. The pair of panels 20, 12 includes a first panel 20 and a second panel 12. The blank 10 is arranged to be formed into a carton sleeve including opposed side walls 14, 16 and a top panel 18, in which the first and second panels 20, 12 then provide bottom panels of the carton, as shown in FIG. 2. The carton may be used for packaging a plurality of articles, for example, yoghurt cartons, cans or bottles.

The second panel 12, a first side wall panel 14, the top panel 18, a second side wall panel 16 and first panel 20 may be arranged in linear series hinged one to the next.

The first panel 20 may form an outer bottom panel of the carton and the second panel 12 may form an inner bottom panel of the carton.

Referring in particular to FIG. 3, first and second panels 20, 12 include a panel interlocking device L for securing together the panels in overlapping relationship. The panel interlocking device L comprises a locking tab 22 (also referred to herein as male tab 22) struck from, or defined within, first panel 20. The panel interlocking device L also comprises a retention tab 42 (also referred to herein as female tab 42) struck from, or defined within, second panel 12. The pair of panels 20, 12 are also referred to herein as mother panels as the male tab 22 and female tab 42 are struck from material that would otherwise form the first or second panels 20, 12 respectively.

The locking tab 22 is hingeably connected to the first panel 20 by a fold line 24. The fold line 24 is spaced from an end edge 26 of first panel 20.

The fold line 24 may be nonlinear, arcuate or curvilinear in shape. In the illustrated embodiment of FIG. 3, the fold line 24 is concavely curved with respect to the end edge 26 of first panel 20, that is to say the fold line 24 appears concave when viewed from the end edge 26 of the first panel 20.

The locking tab 22 comprises a neck portion 28 and a main portion 30, including a shoulder portion 32 contiguous therewith.

The main portion 30 extends beyond the neck portion 28 towards free edge 26 and is separated from the first panel 20 by a first cut line 38 which connects or is contiguous with each of a pair of oppositely disposed cut lines 34, 36. The first cut line 38 defines the shape of the main portion 30 which is optionally an "arrow head" shape. The neck portion 28 may be narrower in width than the adjacent part of the shoulder portion 32 to define at least one locking edge 40 formed along the lower part of the shoulder portion 32.

The pair of oppositely disposed cut lines 34, 36 define side edges of the neck portion 28.

In this way the locking tab 22 is defined, at least in part, by a cutline 34/38/36 formed from the first cut line 38 and the pair of oppositely disposed cut lines 34, 36 which are continuously arranged.

The fold line 24 is offset, inset, from a first end of the neck portion 28. The first end of the neck portion 28 is defined by terminal ends of the cutline 34/38/36.

Optionally, the fold line 24 is defined, in part, by at least one cut line 25 to make folding the locking tab 22 easier.

As shown in FIG. 3, a retention tab 42 (also referred to herein as female tab 42) is struck from, or defined within, the second panel 12. The retention tab 42 defines, at least in part, a locking aperture 43, spaced from an end edge 11 of the second panel 12 as shown in FIG. 4.

The retention tab 42 comprises opposed side edges, a free end edge or distal end and a hinged end edge or proximal end. A second cut line 50 defines the distal edge of the retention tab 42. The opposed side edges are defined by a second pair of oppositely disposed cut lines 46, 48 extending from a respective one of the ends of the second cut line 50. The proximal end is defined in part by a cut line 47. The cutline 47 is disposed between the second pair of oppositely disposed cut lines 46, 48 and is spaced apart from each of the oppositely disposed cut lines 46, 48 so as to define hinge portions 49 therebetween.

The retention tab 42 is generally wider at the proximal end than at the distal end.

Figure 4:
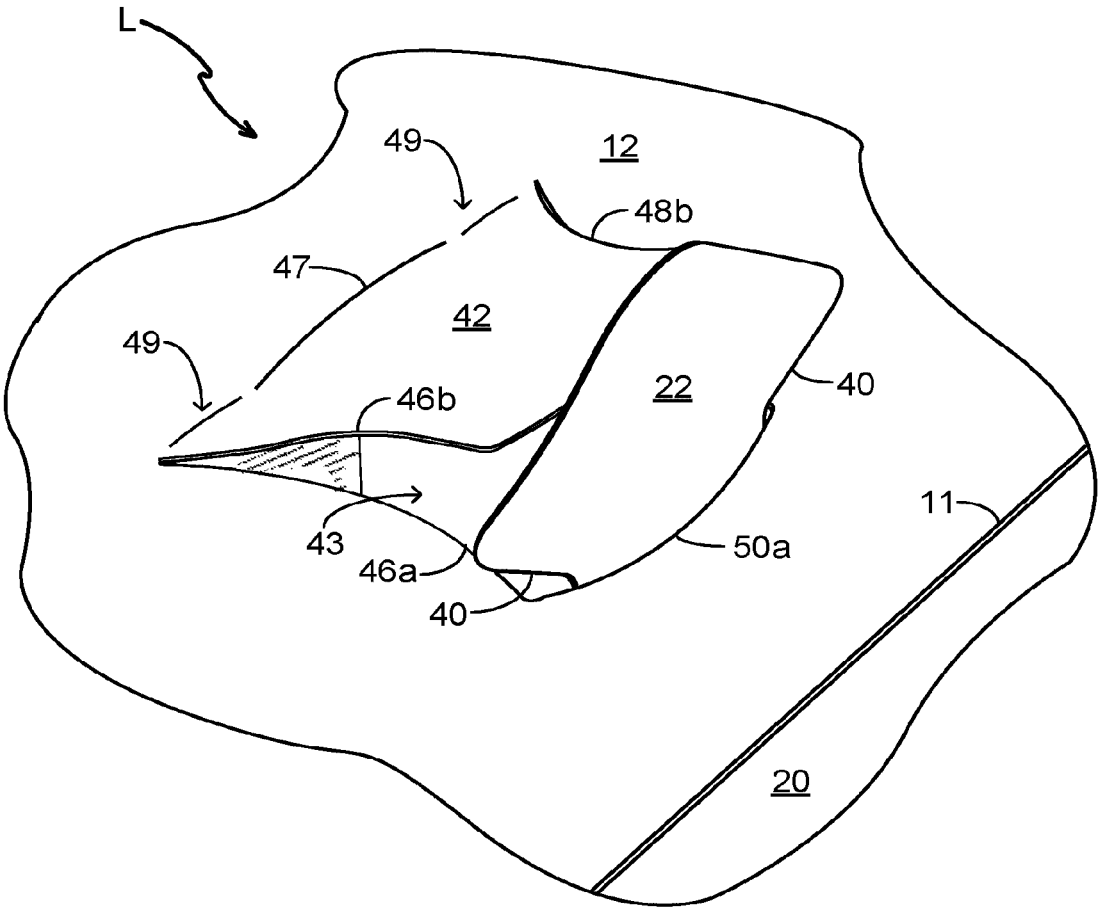
FIGS. 4 and 5 are a perspective views of the panel interlocking device illustrated in FIG. 3 with the pair of panels secured together.

In the illustrated embodiment, cut lines 46, 48, 50 define three edges of the locking aperture 43, shown in FIG. 4.

The cutline 47 is curvilinear in shape, it is concavely curved when viewed from an end edge 11 of the second panel 12. The cutline 47 comprises a first radius of curvature r1 centred at a first point C1.

The cutline 47 may be curved in opposition to the second cutline 50.

The first centre of curvature C1 may be disposed closer to the end edge 11 of the second panel 12 than the cutline 47.

The first centre of curvature C1 may be disposed closer to the end edge 11 of the second panel 12 than the second cut line 50. The first centre of curvature C1 may be located outside the retention tab 42.

The first centre of curvature C1 may be lie upon the second cut line 50, as shown in FIG. 3.

The first centre of curvature C1 may be located within or on the retention tab 42.

The second cut line 50 is curvilinear in shape, it is convexly curved when viewed from an end edge 11 of the second panel 12. The second cut line 50 comprises a second radius of curvature r2 centred at a second point C2.

The second centre of curvature C2 may be disposed further from the end edge 11 of the second panel 12 than the second cut line 50.

The second centre of curvature C2 may be disposed further from the end edge 11 of the second panel 12 than the cut line 47.

The second centre of curvature C2 may be located outside the retention tab 42.

Each of the second pair of oppositely disposed cut lines 46, 48 is curvilinear in shape. Each of the second pair of oppositely disposed cut lines 46, 48 is convexly curved when viewed from position outside of the retention tab 42. A first one 46 of the second pair of oppositely disposed cut lines 46, 48 comprises a third radius of curvature r3 centred at a third point C3. The third centre of curvature C3 is located outside the retention tab 42. A second one 48 of the second pair of oppositely disposed cut lines 46, 48 comprises a fourth radius of curvature r4 centred at a fourth point C4. The fourth centre of curvature C4 is located outside the retention tab 42.

The third centre of curvature C3 and the fourth centre of curvature C4 are disposed on opposite sides of the retention tab 42.

The third centre of curvature C3 and the fourth centre of curvature C4 are located further from the end edge 11 of the second panel 12 than the second cut line 50.

Referring to FIG. 3C the locking tab 22 comprises a length dimension M3 defined between the fold line 24 and an opposing end or tip. The locking tab 22 comprises a first width dimension M2 defined between the outer edges of the shoulder portion 32. The neck portion 28 of the locking tab 22 comprises a second width dimension M1 defined between the cutlines 34, 36.

Figure 3B:
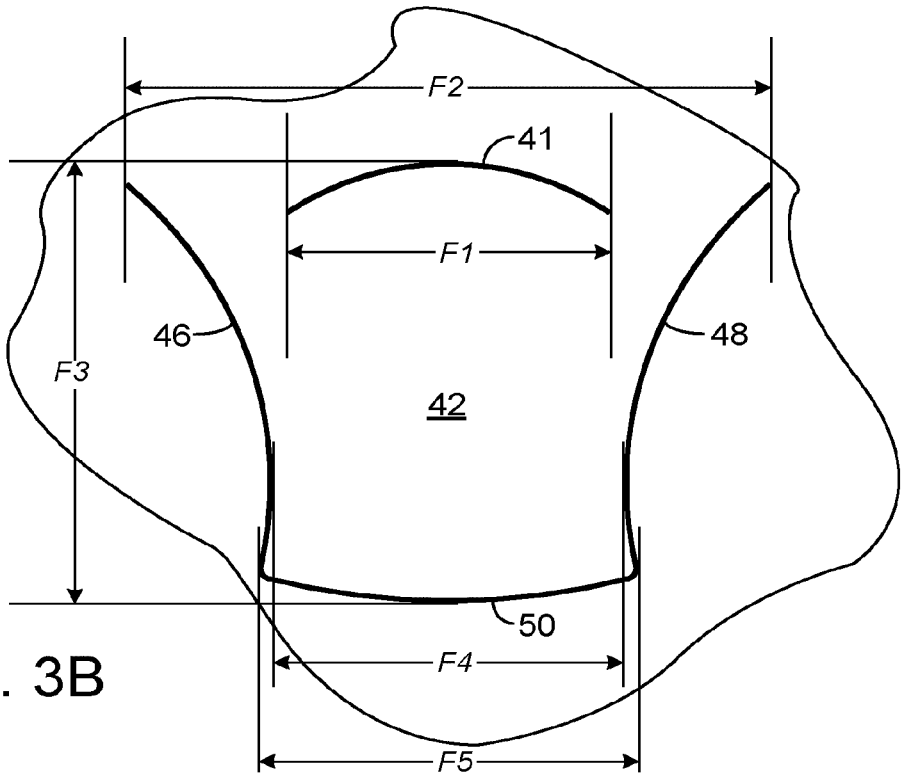
FIG. 3B shows an enlarged view of a locking tab for forming the panel interlocking device according to one aspect of the invention.

Referring to FIG. 3B the retention tab 42 comprises a length dimension F3 defined between proximal end (defined by the cut line 47) and the distal end (defined by the second cut line 50).

The length dimension F3 of the retention tab 42 may be equal to the first radius of curvature r1, (F3=r1).

The retention tab 42 comprises a waist, that is to say is narrower in width at a medial region than at the distal and proximal ends.

The waist of the retention tab 42 comprises a waist width dimension F4.

The opposed ends of the second cutline 50 define the width of the distal end of the retention tab 42, the distal end of the retention tab 42 comprises a distal end width dimension F5.

The distal end width dimension F5 is greater than the waist width dimension F4, (F5>F4).

The opposed ends of the cut line 47 define a linear dimension F1 therebetween. The linear dimension is defined by a chord of a notional circle having a radius equal to the radius of curvature r1 of the cut line 47. The chord extends between the terminal ends of the cut line 47.

The second pair of oppositely disposed cut lines 46, 48 define a width dimension F2 of the proximal end of the retention tab 42. The proximal end of the retention tab 42 is wider than the distal end and the waist of the retention tab 42, (F2>F5>F4).

The waist (minimum width F4) of the retention tab 42 may be located in closer proximity to the distal end of the retention tab 42 than the proximal end of the retention tab 42.

The width dimension F2 of the proximal end of the retention tab 42 may be substantially equal to the second radius of curvature r2, (F2=r2).

The third radius of curvature r3 and the fourth radius of curvature r4 may be substantially equal to two thirds of the width dimension F2 of the proximal end of the retention tab 42, (r3=r4=⅔ F2).

The linear dimension F1 of the cut line 47 may be equal to the width dimension M1 of the neck portion 28 of the locking tab 22, (F1=M1).

The length dimension F3 of the retention tab 42 may be substantially equal to the length dimension M3 of the locking tab 22.

The width dimension M2 of the shoulder portion 32 of the locking tab 22 may be equal to width dimension F2 of the proximal end of the retention tab 42 minus 1 mm, (M2=F2−1 mm).

The waist width dimension F4 may be equal to the linear dimension F1 of the cut line 47 plus 0.5 mm, (F4=F1+0.5 mm).

The distal end width dimension F5 may be equal to the linear dimension F1 of the cut line 47 plus 1 mm, (F5=F1+1 mm).

In some embodiments, the linear dimension F1 of the cut line 47 may be in the range 4 mm to 8 mm, (4 mm<F1<8 mm), and in some embodiments may be equal to 6 mm, (F1=6 mm).

In some embodiments, the width dimension F2 of the proximal end of the retention tab 42 may be in the range 10 mm to 14 mm, (10 mm<F2<14 mm), and in some embodiments may be equal to 12 mm, (F2=12 mm).

In some embodiments, the length dimension F3 of the retention tab 42 may be in the range 7 mm to 11 mm, (7 mm<F3<11 mm), and in some embodiments may be equal to 9 mm, (F3=9 mm).

In some embodiments, the first radius of curvature r1 may be in the range 7 mm to 11 mm, (7 mm<r1<11 mm), and in some embodiments may be equal to 9 mm, (r1=9 mm).

In some embodiments, the second radius of curvature r2 may be in the range 10 mm to 14 mm, (10 mm<r2<14 mm), and in some embodiments may be equal to 12 mm, (r2=12 mm).

In some embodiments, the third radius of curvature r3 may be in the range 6 mm to 10 mm, (6 mm<r3<10 mm), and in some embodiments may be equal to 8 mm, (r3=8 mm).

It is envisaged that a carton may be provided with a number of locking tabs and retention tabs that are substantially identical to locking tab 22, retention tab 42 in order to lock together two panels and are not therefore described in any greater detail. Further, it is envisaged that the panel interlocking means can comprise a "half lock": the locking tab, retaining tab and locking aperture being formed to one side of a notional centre line X only, shown in FIG. 3. In such embodiments one or both sides of the retaining tab and/or locking aperture may be concavely curved in shape. The general principle of applying an invention of panel interlocking means to a half lock is well known in the art. Thus it will be apparent to a person skilled in the art that the present invention includes half locks incorporating those relevant features of the present invention.

Figure 5:
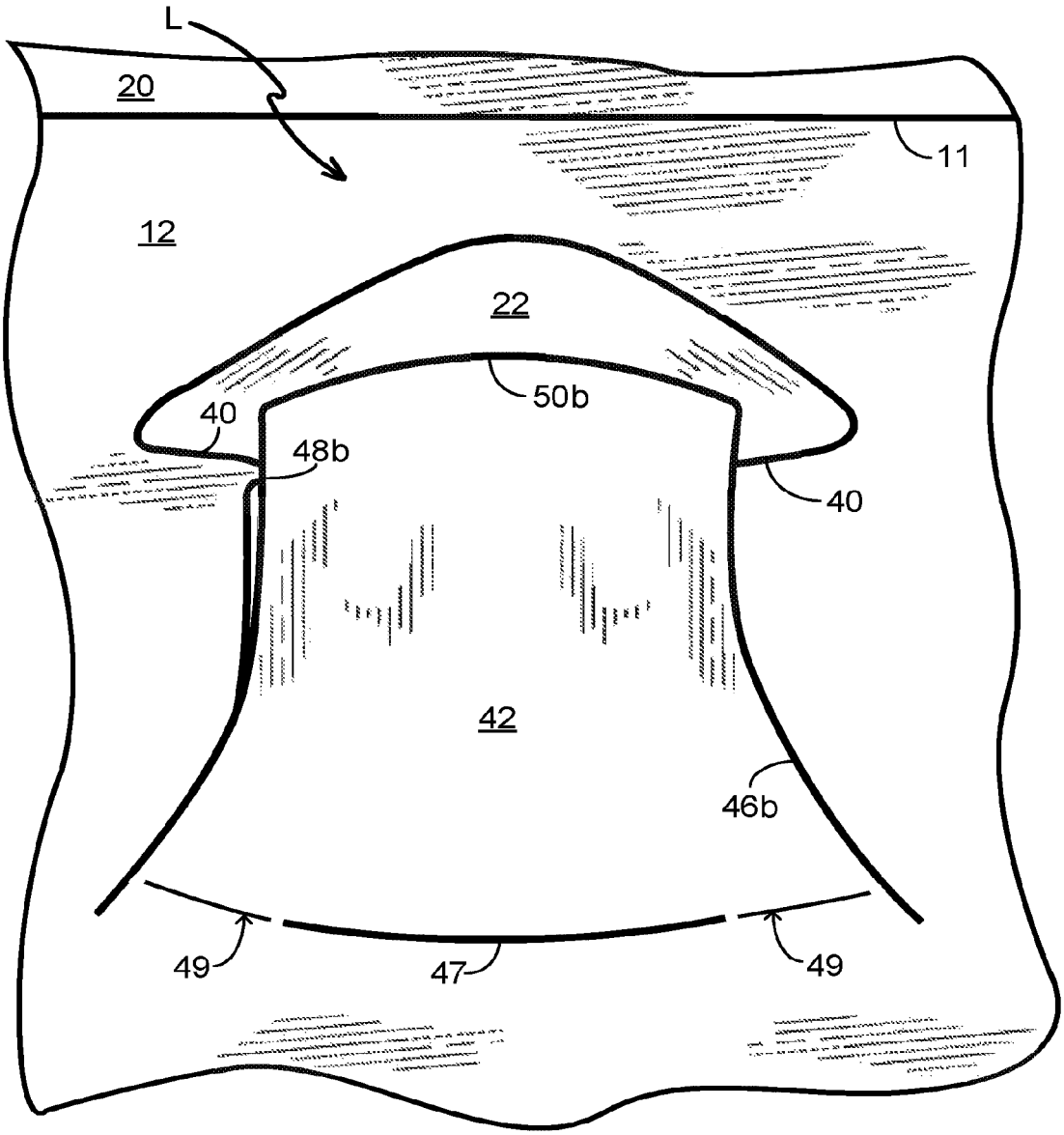

In order to lock together first and second panels 20 and 12, they are brought into an overlapping relationship with each other, and the locking tab 22 is folded out of alignment with first panel 20, shown in FIGS. 4 and 5. The retention tab 42 is folded out of alignment with first panel 12 and the locking tab 22 is punched through the aperture 43, which in this embodiment is defined by the retention tab 42.

As locking tab 22 passes through the aperture 43 shown in FIG. 4, it continues to be folded about the fold line 24 and into a substantially perpendicular relationship with the first and second panels 20, 12 such that the locking tab 22 is pushed beyond the distal edge 50 of the retention tab 42 shown in FIG. 5. Thus, the locking tab 22 is held in position because the retention tab 42 abuts one side of the locking tab 22 to prevent it from springing back to its original position. The locking tab 22 may abut an edge of the aperture 43 corresponding to the distal edge 50 of the retention tab 42 thereby retaining the locking tab 22 in a substantially perpendicular relationship with respect to the first and second panels 20, 12.

As illustrated in FIGS. 4 and 5, the base of the shoulder portion 32 is held in place by abutment between the locking edge 40 and the panel portions of the second panel 12, as the shoulder portions are broader than the locking aperture 43 in vertical or oblique positions.

Tension may be applied to the first and second panels 20, 12 in opposition to the locking direction; i.e. in a direction tending to move the first and second panels 20, 12 apart. Thus, the butt engagement between the locking tab 22 and the retention tab 42 maintain the locking tab 22 in its locked condition. The first and second panels 20, 12 may remain interlocked because the front edge of the aperture 43 is in butt or contacting engagement with the fold line 24 of first panel 20 and, as explained above, the locking edges 40 of locking tab 22 are supported by the panel portions of second panel 12.

The aperture 43 comprises a waist due to the shape and arrangement of the second pair of oppositely disposed cut lines 46, 48. In some embodiments the waist width dimension F4 may be less than the width dimension M1 of the neck portion 28 of the locking tab 22, (F4<M1).

The waist of the aperture 43 may therefore inhibit movement of the locking tab 22, the locking tab 22 may require deformation or bending to pass through the waist. In this way the waist increases resistance and improves security of the locking tab 22 when received at the distal end of the aperture 43.

The distal end of the aperture 43, defined by the cutline 50, may be arranged to accommodate the neck portion of the locking tab 22. The locking tab 22 may adopt the curved shape of the distal end of the aperture 43 when located adjacent thereto. The curved distal end of the retention tab 42 may encourage or facilitate the deformation of the locking tab 22.

The fold line 24 hinging the locking tab 22 to the first panel 20 may be shaped similarly to the curved shape of the distal end of the aperture 43 and to the curved distal end of the retention tab 42.

The curved arrangement of the fold line 24, the distal end of the aperture 43 and the distal end of the retention tab 42 may bias the locking tab 22 towards engagement with distal end of the aperture 43.

Referring now to FIGS. 6 to 9 there is shown an alternative embodiments of the present disclosure. In the second, third and fourth illustrated embodiments, like numerals have, where possible, been used to denote like parts, albeit with the addition of the prefix "100", "200", "300" to indicate that these features belong to the second, third and fourth embodiments respectively. The alternative embodiments share many common features with the embodiment of FIGS. 1 to 5, therefore only the differences from the embodiment illustrated in FIGS. 1 to 5 will be described in any greater detail.

Figure 7:
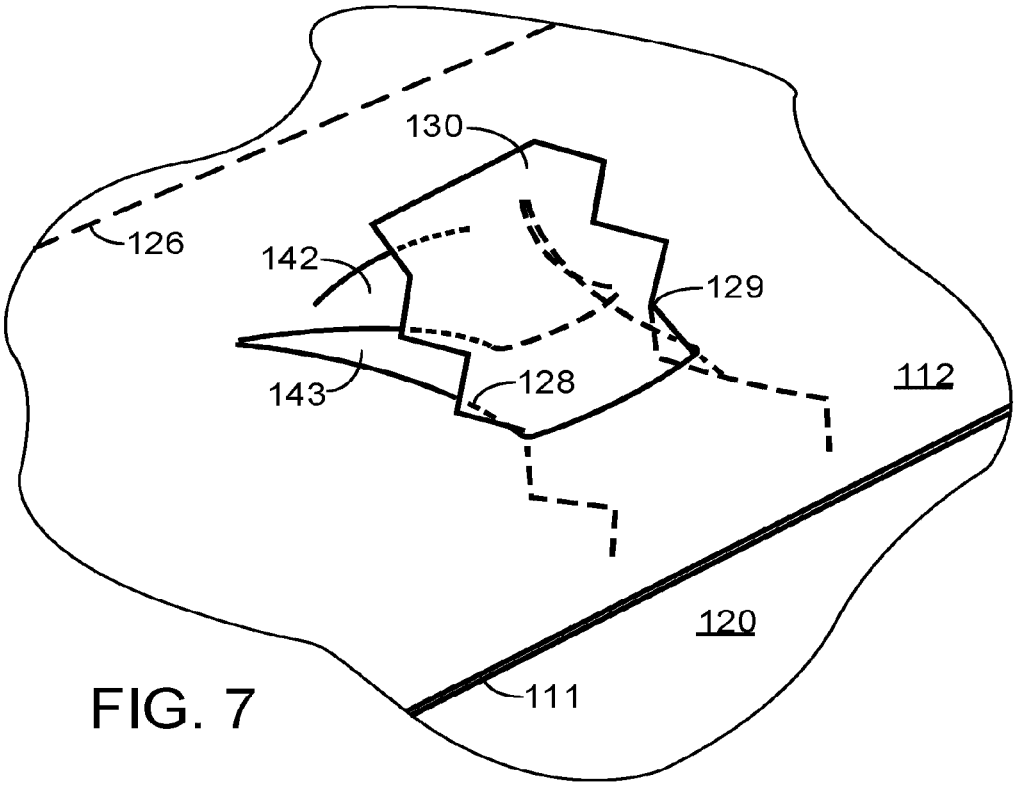
FIG. 7 is a perspective view of an internal or upper-side part of the panels held in overlapping relationship by the panel interlocking device illustrated in FIG. 6.
Figure 6:
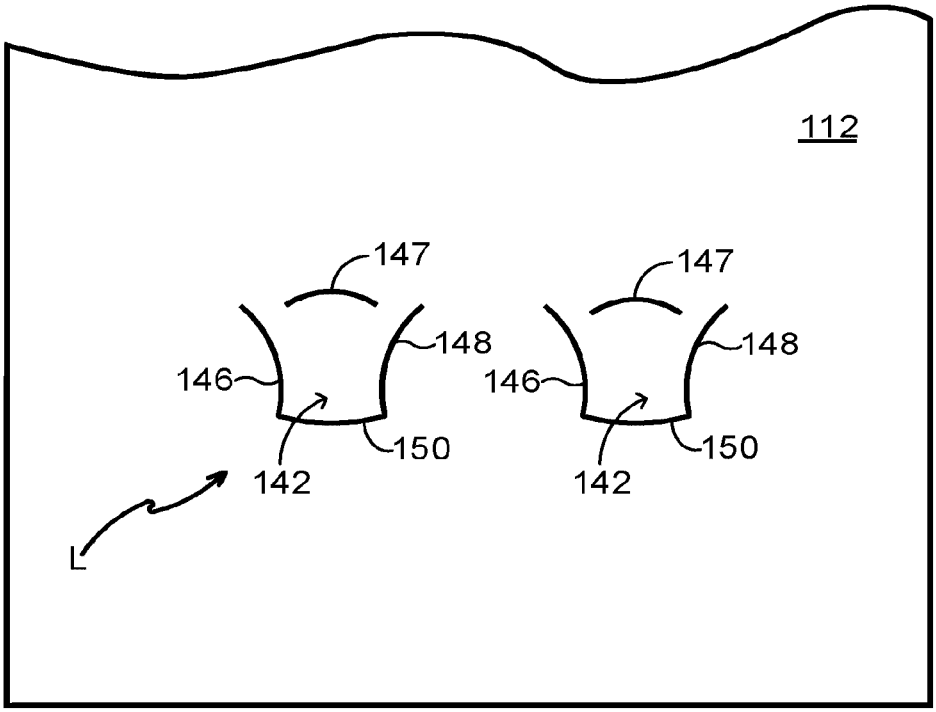
FIG. 6 shows a part of a pair of panels in close proximity, incorporating a panel interlocking device according to a second embodiment of the invention.
Figure 6:
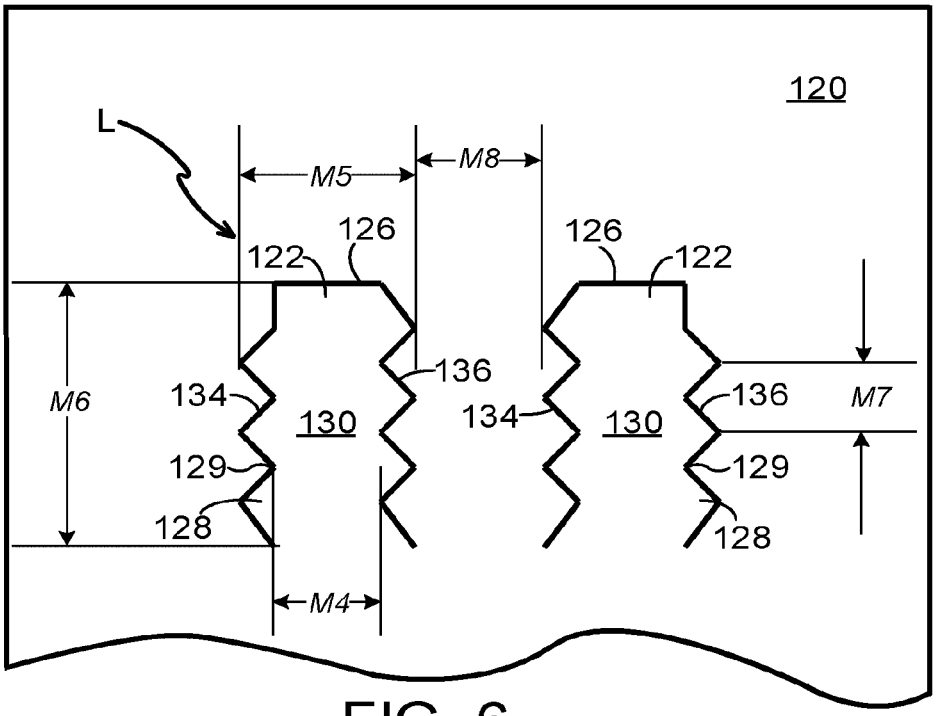

A second embodiment is shown in FIG. 6 and FIG. 7, referring to FIG. 6, there is shown a pair of panels 120, 112 respectively are adapted to be interlocked and are formed from paperboard or similar foldable sheet material. As in the first embodiment the panels 120, 112 may, for example, be disposed at the opposite ends of one and the same wrap-around carton blank which is to be formed into a carton sleeve including opposed side walls and a top panel, in which panels 120, 112 then provide bottom panels of the carton. The carton is used for packaging a plurality of articles, for example, yoghurt, cartons, cans or bottles.

First and second panels 120, 112 include a pair of panel interlocking device L for securing together the panels in overlapping relationship. Each of the panel interlocking L means comprises locking tab 122 which is struck from first panel 120 and is hingeably connected thereto. In this embodiment, the locking tab 122 is defined by a pair of oppositely disposed cut lines 134, 136 to define the side edges of a main portion 130.

In the second embodiment the locking tab 122 (male tab 122) forms a multi-position locking tab, whereas in the embodiment illustrated in FIGS. 1 to 5 the locking tab 22 (male tab 22) formed a single position locking tab.

Locking tab 122 terminates at an end edge 126 and is separated from first panel 120 by a cut line which connects cut lines 134 and 136 and to define the shape of the main portion. Preferably, the locking tab 122 is generally elongate in shape. In this embodiment, the cut lines 134, 136 are non-linear to define at least one recess 129. More preferably, the cut lines 134, 136 are serrated, with the or each recess 129 being defined between adjacent teeth 128 and providing an engagement edge. Thus, the tab 122 can be engaged in a number of positions depending upon how much the panels are required to be overlapped.

The locking tab 122 comprises minimum width dimension M4 defined between the recesses 129 on one side of the main portion 130 and the recesses 129 provided on the opposing side. In some embodiments the minimum width dimension M4 of the locking tab 122 is substantially equal to the linear dimension F1 of the cut line 147 plus 1 mm, (M4≅F1+1 mm).

The locking tab 122 comprises maximum width dimension M5 defined between the teeth 128 on one side of the main portion 130 and the teeth 128 provided on the opposing side. In some embodiments the maximum width dimension M5 of the locking tab 122 is substantially equal to the maximum width dimension F2 of the retention tab 142 minus 0.5 mm, (M5≅F2−0.5 mm).

The locking tab 122 comprises length dimension M6 defined between end edge 126 and terminal ends of cut lines 134 and 136 defining the proximal end of the main portion 130. In some embodiments the length dimension M6 of the locking tab 122 is substantially equal to the maximum width dimension F2 of the retention tab 142 plus 7 mm, (M6≅F2+7 mm).

The teeth 128 are arranged at a pitch or period having a linear dimension M7, adjacent recesses 129 are similarly spaced apart by linear dimension M7. In some embodiments the pitch dimension M7 is substantially equal to the linear dimension F1 of the cut line 147 minus 1 mm, (M7≅F1−1 mm).

In the illustrated embodiment the locking tab 122 of a first one of the pair of panel interlocking devices L is spaced apart from the locking tab 122 of a second one of the pair of panel interlocking devices L by a spacing distance M8. In some embodiments the spacing distance M8 is substantially equal to the length F3 of the retention tab 142 minus 0.5 mm, (M8≅F3−0.5 mm).

As shown in FIG. 6, a retention tab 142 is struck from second panel 112 which extends into a locking aperture 143, see FIG. 7. Preferably, the retention tab 142 constructed substantially similarly to the retention tab 42 of the embodiment of FIGS. 1 to 5 and will not be described in further detail.

It will be appreciated by those skilled in the art that a carton may be provided with a number of locking tabs and retention tabs which are substantially identical to locking tab 122 and retention tab 142 in order to lock together two panels and are not therefore described in any greater detail.

The process for locking together the first and second panels 120 and 112 is substantially identical to the locking together of panels 10 and 12 of the first embodiment, and will not, therefore, be discussed in further detail.

Referring to FIG. 7, once panels 120 and 112 have been locked together, and locking tab 122 has been folded into a substantially perpendicular relationship with panels 120, 112, it is held in position because retention tab 142 abuts one of its faces to prevent it from springing back to its original position, and the corresponding edges of aperture 143 engage the opposed recesses 129 of locking tab 122. In those embodiments in which the teeth 128 of the opposing side edges are offset, the locking tab 122 may tend to twist or deform to retain it.

The locking tab 122 is held in place by abutment of the teeth 128 with the second panel, as the teeth are broader than the narrow part of locking aperture 143 in vertical or oblique positions.

Figure 8:
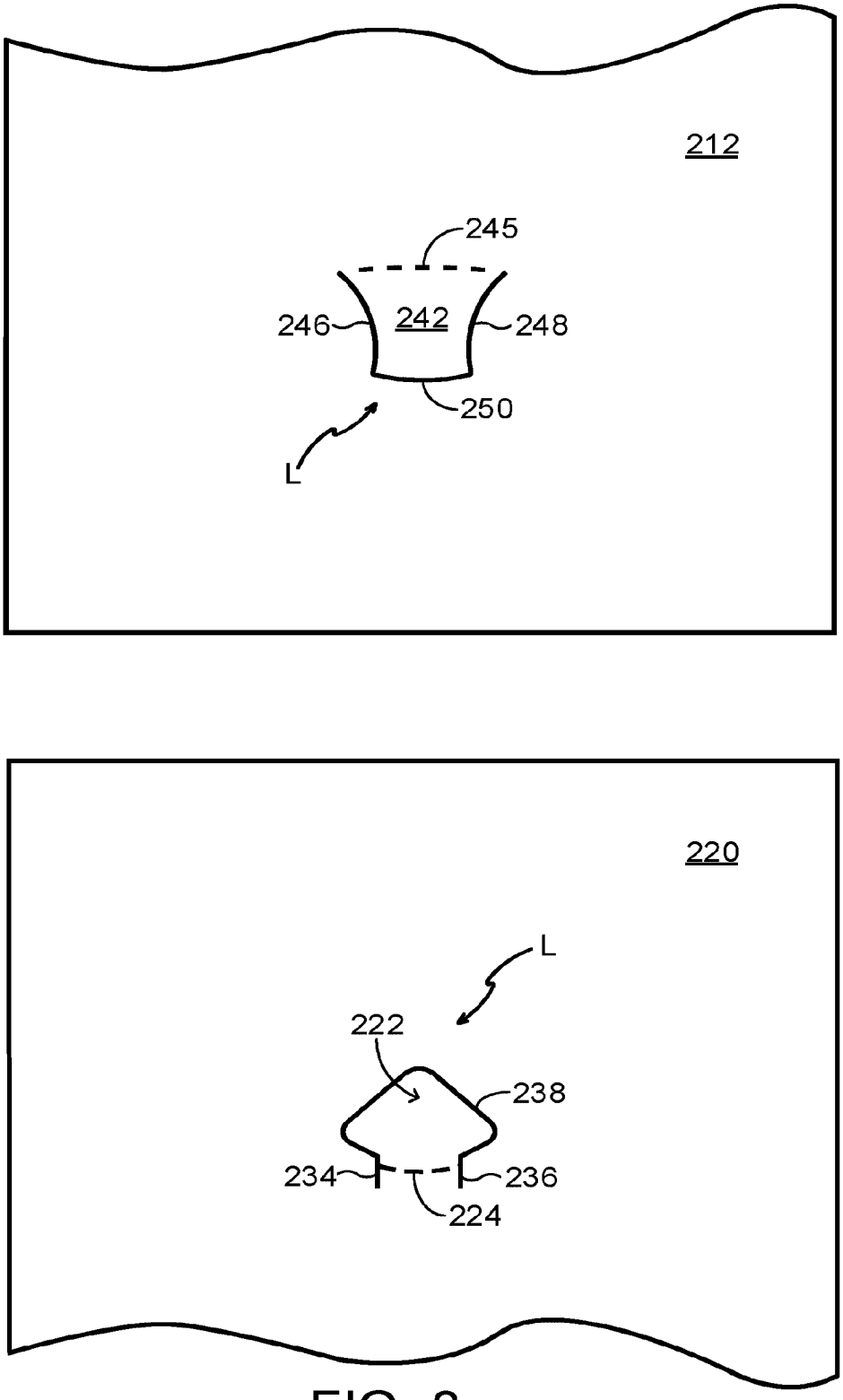
FIGS. 8 and 9 show examples of a panel interlocking device formed from a pair of panels which can be the opposite ends of a wraparound carton blank, in close proximity, according to third and fourth embodiments of the invention.

A third embodiment is shown in FIG. 8, the third embodiment is substantially similar to that of FIGS. 1 to 5, in the third embodiment the cutline 47 has been replaced with a fold, score or crease line 245. The crease line 245 may be formed from a scored line, an embossed line, a debossed line, a line of perforations, a line of short slits, a line of half-cuts, a single half-cut, an interrupted cutline, a line of aligned slits, a line of scores or any combination thereof.

Figure 9:
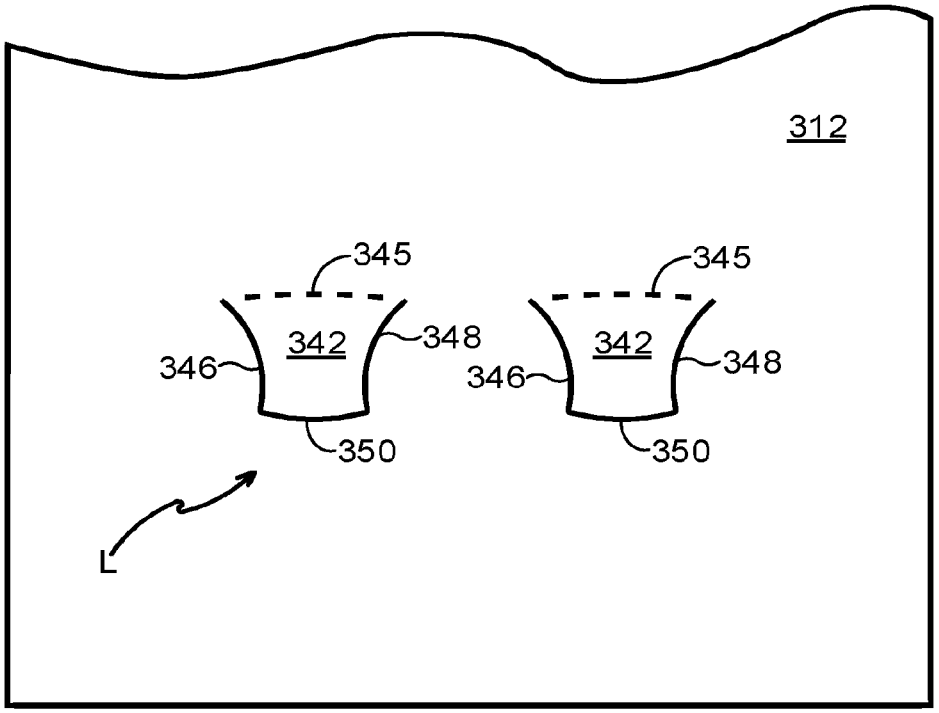
Figure 9:
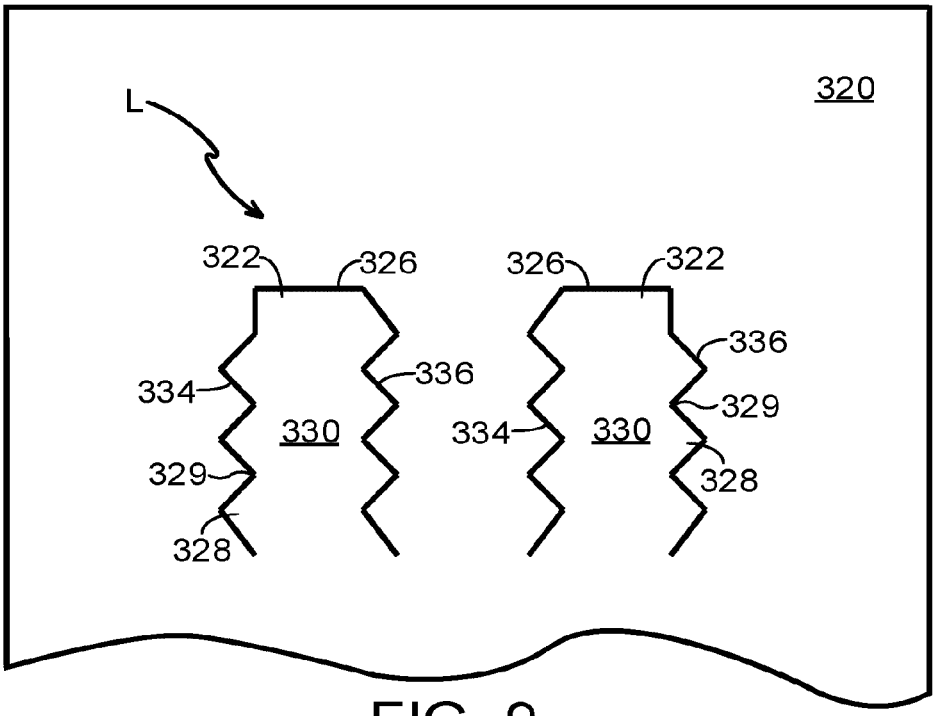

A fourth embodiment is shown in FIG. 9, the fourth embodiment is substantially similar to that of FIGS. 6 and 7, in the fourth embodiment the cutline 147 has been replaced with a fold, score or crease line 345. The crease line 345 may be formed from a scored line, an embossed line, a debossed line, a line of perforations, a line of short slits, a line of half-cuts, a single half-cut, an interrupted cutline, a line of aligned slits, a line of scores or any combination thereof.

The panel interlocking means of the third and fourth embodiments are formed by a similar method to that described above and are not therefore described in any more detail.

The present invention and its exemplary embodiments relates to a means of locking two adjacent panels in a carton and is shaped to provide satisfactory strength in a locked position. The carrier can be formed by hand or machinery. It is anticipated that the invention can be applied to a variety of carriers not limited to those of the wraparound type.

It can be appreciated that various changes may be made within the scope of the present invention. For example, the size and shape of the panels and apertures may be adjusted to accommodate articles of differing size or shape.

It will be recognised that as used herein, directional references such as "top", "bottom", "base", "front", "back", "end", "side", "inner", "outer", "upper" and "lower" do not necessarily limit the respective panels to such orientation, but may merely serve to distinguish these panels from one another.

As used herein, the terms "hinged connection" and "fold line" refer to all manner of lines that define hinge features of the blank, facilitate folding portions of the blank with respect to one another, or otherwise indicate optimal panel folding locations for the blank. Any reference to "hinged connection" should not be construed as necessarily referring to a single fold line only; indeed a hinged connection can be formed from two or more fold lines wherein each of the two or more fold lines may be either straight/linear or curved/curvilinear in shape. When linear fold lines form a hinged connection, they may be disposed parallel with each other or be slightly angled with respect to each other. When curvilinear fold lines form a hinged connection, they may intersect each other to define a shaped panel within the area surrounded by the curvilinear fold lines. A typical example of such a hinged connection may comprise a pair of arched or arcuate fold lines intersecting at two points such that they define an elliptical panel therebetween. A hinged connection may be formed from one or more linear fold lines and one or more curvilinear fold lines. A typical example of such a hinged connection may comprise a combination of a linear fold line and an arched or arcuate fold line which intersect at two points such that they define a half moon-shaped panel therebetween.

As used herein, the term "fold line" may refer to one of the following: a scored line, an embossed line, a debossed line, a line of perforations, a line of short slits, a line of half-cuts, a single half-cut, an interrupted cutline, a line of aligned slits, a line of scores and any combination of the aforesaid options.

It should be understood that hinged connections and fold lines can each include elements that are formed in the substrate of the blank including perforations, a line of perforations, a line of short slits, a line of half-cuts, a single half-cut, a cutline, an interrupted cutline, slits, scores, any combination thereof, and the like. The elements can be dimensioned and arranged to provide the desired functionality. For example, a line of perforations can be dimensioned or designed with degrees of weakness to define a fold line and/or a severance line. The line of perforations can be designed to facilitate folding and resist breaking, to facilitate folding and facilitate breaking with more effort, or to facilitate breaking with little effort.

The phrase "in registry with" as used herein refers to the alignment of two or more elements in an erected carton, such as an aperture formed in a first of two overlapping panels and a second aperture formed in a second of two overlapping panels. Those elements in registry with each other may be aligned with each other in the direction of the thickness of the overlapping panels. For example, when an aperture in a first panel is "in registry with" a second aperture in a second panel that is placed in an overlapping arrangement with the first panel, an edge of the aperture may extend along at least a portion of an edge of the second aperture and may be aligned, in the direction of the thickness of the first and second panels, with the second aperture.

The invention claimed is:

1. A panel interlocking device for joining a first panel and a second panel, the panel interlocking device comprising:

a male tab on the first panel; and a female tab having opposing side edges on the second panel, wherein each of the opposing side edges of the female tab is formed entirely by a cut line, so as to separate the female lab from the second panel along each of the opposing side edges, such that each of the opposing side edges of the female tab formed by ne is concavely curved as viewed from outside of the female tab.

2. A panel interlocking device according to claim 1 wherein a center of curvature of each of the opposing side edges is disposed outside the female tab.

3. A panel interlocking device according to claim 2 wherein a minimum width F4 of the female tab is located between a distal end of the female tab having a width F5 and a proximal end of the female tab having a width F2 such that both of the width F5 at the distal end and the width F2 at the proximal end is greater than the minimum width F4, (F5>F4), (F2>F4).

4. A panel interlocking device according to claim 3 wherein the width F2 at the proximal end is the maximum width of the female tab.

5. A panel interlocking device according to claim 4 wherein a radius r3 of curvature of each of the opposing side edges is generally equal to two-thirds of the maximum width F2 of the female tab, ($r3 \cong \frac{2}{3}F2$).

6. A panel interlocking device according to claim 1 wherein the male tab comprises a single-position tab comprising:

a main portion;

a neck portion; and a shoulder portion;

wherein the neck portion is narrower in width than the shoulder portion to define at least one locking edge formed along a lower part of the shoulder portion, and wherein a maximum width F2 of the female tab is greater than a maximum width M2 of the single-position tab, (F2>M2).

7. A panel interlocking device according to claim 6 wherein a distal end of the female tab having a width F5 is less than the maximum width M2 of the single-position tab, (F5<M2).

8. A panel interlocking device according to claim 1 wherein the female tab is connected to a mother panel by a non-linear fold line.

9. A panel interlocking device according to claim 8 wherein the non-linear fold line comprises a curved fold line.

10. A panel interlocking device according to claim 9 wherein a center of a curvature of the curved fold line is located at a position closer to a distal end of the female tab than to the curved fold line.

11. A panel interlocking device according to claim 8 wherein the non-linear fold line has a length F1 which is: (i) less than a maximum width F2 of the female tab, (F1<F2), or (ii) less than a minimum width F4 of the female tab, (F1<F4), or (iii) is generally equal to a minimum width M1/M4 of the male tab, (F1≅M1), (F1≅M4).

12. A panel interlocking device according to claim 1 wherein the male tab comprises a multi-position tab comprising a plurality of recesses along at least one side edge thereof, each recess providing an engagement edge for abutment with a panel portion of a mother panel from which the female tab is struck and wherein a maximum width F2 of the female tab is greater than a maximum width M5 of the multi-position tab.

13. A panel interlocking device according to claim 12 wherein a distal end of the female tab having a width F5 is less than a maximum width M5 of the multi-position tab, (F5<M5).

14. A panel interlocking device according to claim 1 wherein the female tab has a distal end edge convexly curved as viewed from outside of the female tab.

15. A panel interlocking device according to claim 14 wherein a center of curvature of the distal end edge is located at a position closer to a proximal end of the female tab than to a distal end of the female tab.

16. A panel interlocking device according to claim 15 wherein a radius r2 of curvature of the distal end edge is: (i) greater than a radius r3 of curvature of each of the opposing side edges, (r2>r3), or (ii) generally equal to a maximum width F2 of the female tab, (r2≅F2), or both (i) and (ii).

17. A panel interlocking device according to claim 1, wherein the curved cut line extends from a distal end edge of the female tab to a proximal end portion of the female tab, in a direction along which free side edges of the second panel extend, such that each of the opposing side edges of the female tab is concavely curved along substantially its entire length.

18. A panel interlocking device for securing together a first panel and a second panel in overlapping relationship, said panel interlocking device comprising:

a locking tab struck from the first panel, and a retaining tab defining a locking aperture struck from the second panel, wherein the retaining tab is displaced out of plane of the second panel to receive the locking tab through the locking aperture to be engaged therewith, wherein at least one of the locking aperture and the retaining tab has opposing side edges that extend in a direction substantially parallel to free side edges of the first panel or the second panel, wherein the opposing side edges of the at least one of the locking aperture and the retaining tab are concavely curved as viewed from outside of the at least one of the locking aperture and the retaining tab.

19. A panel interlocking device according to claim 18 wherein a center of curvature of the at least one of the opposing side edges that is concavely curved is disposed outside the at least one of the locking aperture and the retaining tab.

20. A panel interlocking device according to claim 19 wherein a minimum width F4 of the locking aperture is located between a distal end of the locking aperture having a width F5 and a proximal end of the locking aperture having a width F2 such that both the width F5 at the distal end and the width F2 at the proximal end is greater than the minimum width F4, (F5>F4), (F2>F4).

* * * * *